US008468838B2

(12) United States Patent
Backhaus et al.

(10) Patent No.: US 8,468,838 B2
(45) Date of Patent: Jun. 25, 2013

(54) THERMOACOUSTIC REFRIGERATORS AND ENGINES COMPRISING CASCADING STIRLING THERMODYNAMIC UNITS

(75) Inventors: Scott Backhaus, Espanola, NM (US); Greg Swift, Santa Fe, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 951 days.

(21) Appl. No.: 12/415,880

(22) Filed: Mar. 31, 2009

(65) Prior Publication Data

US 2009/0249797 A1 Oct. 8, 2009

Related U.S. Application Data

(60) Provisional application No. 61/072,685, filed on Apr. 1, 2008.

(51) Int. Cl.
*F25B 9/00* (2006.01)

(52) U.S. Cl.
USPC ..... 62/6

(58) Field of Classification Search
USPC ..... 62/6, 335, 175, 612; 60/520
See application file for complete search history.

(56) References Cited

U.S. PATENT DOCUMENTS

| | | | | |
|---|---|---|---|---|
| 4,114,380 | A | 9/1978 | Ceperley | |
| 5,953,920 | A | 9/1999 | Swift et al. | |
| 6,032,464 | A | 3/2000 | Swift et al. | |
| 6,389,819 | B1 * | 5/2002 | Zhu et al. | 62/6 |
| 6,658,862 | B2 * | 12/2003 | Swift et al. | 62/6 |
| 6,691,520 | B2 * | 2/2004 | Kamoshita et al. | 62/6 |
| 7,628,022 | B2 | 12/2009 | Spoor et al. | |
| 2006/0059921 | A1 * | 3/2006 | Hao et al. | 62/6 |

OTHER PUBLICATIONS

K. Kanao et al., "A Miniature Pulse Tube Refrigerator for Temperatures below 100 K," 34 Cryogenics, ICEC Supplement, pp. 167-169 (1994).*

Radebaugh, "A Review of Pulse Tube Refrigeration," Advances in Cryogenic Engineering, vol. 35 (1990) pp. 1191-1205.

Kittel, "Ideal Orifice Pulse Tube Refrigerator Performance," Cryogenics, vol. 32, (Feb. 1992) pp. 843-844.

Swift, Thermoacoustics: A Unifying Perspective for Some Engines and Refrigerators, Published by Acoustical Society of America, Sewickley, PA (2002).

Notification of Transmittal of the International Search Report and the Written Opinion of the International Searching Authority, or the Declaration issued on Jun. 3, 2009 for corresponding International Application PCT/US09/39177 filed on Apr. 1, 2009 (8 pages).

* cited by examiner

*Primary Examiner* — Melvin Jones
(74) *Attorney, Agent, or Firm* — Juliet A. Jones; Meredith Hope Schoenfeld; Ryan B. Kennedy

(57) ABSTRACT

The present invention includes a thermoacoustic assembly and method for improved efficiency. The assembly has a first stage Stirling thermal unit comprising a main ambient heat exchanger, a regenerator and at least one additional heat exchanger. The first stage Stirling thermal unit is serially coupled to a first end of a quarter wavelength long coupling tube. A second stage Stirling thermal unit comprising a main ambient heat exchanger, a regenerator, and at least one additional heat exchanger, is serially coupled to a second end of the quarter wavelength long coupling tube.

20 Claims, 10 Drawing Sheets

THERMOACOUSTIC REFRIGERATORS AND ENGINES COMPRISING CASCADING STIRLING THERMODYNAMIC UNITS

RELATED APPLICATIONS

This patent application claims the benefit of the filing date of U.S. Provisional patent application No. 61/072,685 filed on Apr. 1, 2008, under 35 U.S.C. 119(e).

STATEMENT OF FEDERAL RIGHTS

The United States government has rights in this invention pursuant to Contract No. DE-AC52-06NA25396 between the United States Department of Energy and Los Alamos National Security, LLC for the operation of Los Alamos National Laboratory.

FIELD OF THE INVENTION

The present invention relates to thermoacoustic pulse-tube refrigerators and thermoacoustic-Stirling engines comprising a series of Stirling thermodynamic units, useful for providing refrigeration, heat pumping, acoustic power amplification, or combinations thereof.

BACKGROUND OF THE INVENTION

Pulse-tube refrigerators are robust and reliable devices for providing cryogenic refrigeration powered by acoustic energy. A traditional single-stage pulse-tube refrigerator (PTR) 1, shown in FIG. 1, comprises a sealed volume filled with a thermodynamic working fluid, typically high pressure helium gas. Inside the sealed volume is a Stirling thermodynamic unit (STU) 2 consisting of a main ambient heat exchanger 3, a regenerator 13, and a cold heat exchanger 5. The remainder of the sealed volume includes a thermal buffer tube (TBT) 11, an acoustic network 9, and secondary ambient heat exchanger 15. The main ambient heat exchanger 3 allows waste heat to exit the STU 2 at ambient temperature, while the refrigeration load enters the STU 2 via the cold heat exchanger 5 from a lower temperature heat source or cooled space or substance. Those skilled in the art will recognize that a refrigerator can also operate as a heat pump where the heat rejection, which is the desired output of the heat pump, takes place at heat exchanger 3 at a temperature higher than ambient. The STU 2 is driven by some form of acoustic wave generator 7, for example, an electrodynamic linear compressor or a thermoacoustic engine, which launches a high-amplitude acoustic wave into the STU 2 near the main ambient heat exchanger 3 (often called the aftercooler in the pulse tube refrigerator literature). For a given oscillatory pressure amplitude generated by the acoustic wave generator 7, the oscillatory volume flow rate amplitude and time phasing relative to the acoustic pressure is mainly set by the acoustic impedance of the acoustic network 9 extending away from the ambient end of the TBT 11 (described below). In typical STU's, the time phase of the complex volumetric flow rate amplitude $U_1$ at the main ambient heat exchanger 3 leads the phase of the complex pressure amplitude $p_1$ by anywhere from 0 to 50 degrees. In between the main ambient heat exchanger 3 and cold heat exchanger 5 is a regenerator 13 where the pressure and displacement oscillations in the acoustic wave produce the STU's 2 cooling power by pumping heat from the cold heat exchanger 5 to the main ambient heat exchanger 3. During this process, some of the acoustic power contained in the wave is consumed. However, there is a significant amount of residual acoustic power that flows away from the STU 2 through the cold heat exchanger 5.

After the cold heat exchanger 5 is the TBT 11 whose role is to allow the acoustic wave (and the residual acoustic power carried by that wave) to propagate away from the cold heat exchanger 5 and to ambient temperature while thermally isolating the STU's cold heat exchanger 5 from ambient temperature. Following the TBT 11 is an ambient temperature acoustic network 9 that provides an acoustic termination for the PTR 1 and dissipates the residual acoustic power carried by the wave. The intervening secondary ambient heat exchanger 15 rejects the heat generated by the dissipation to ambient temperature. TBTs are susceptible to significant secondary flows due to potentially poorly distributed oscillating flows at their ends, e.g. jets emanating from cold heat exchanger 5 and secondary ambient heat exchanger 15. To minimize such secondary flows, flow straighteners may be placed at both ends of a TBT, but for clarity, they are not shown in the Figures.

Although PTRs are robust and reliable, they are inherently irreversible refrigerators because the residual acoustic power flowing from the cold heat exchanger 5 must be dissipated in the acoustic network 9 to provide appropriate acoustic conditions at the inlet to the STU 2 (near the main ambient heat exchanger 3). The recovery and useful application of this residual power are key to improving the efficiency of this refrigeration technique. The following describes some previously described means for recovering the residual power and increasing efficiency.

FIG. 2 shows a feedback pulse-tube refrigerator (FPTR) 21 (disclosed in U.S. Pat. No. 6,032,464), which comprises a lumped-element acoustic network ("network") 27 consisting of a compliance volume 23 and inertance tube 25 (typically much shorter than a quarter of an acoustic wavelength in the working fluid) to recycle the residual acoustic power back to the main ambient heat exchanger 3. Because of the acoustic properties of the network 27, the left-right order of the main ambient heat exchanger 3 and the cold heat exchanger 5 and regenerator 13 in the STU 2 are reversed in FIG. 2 relative to FIG. 1; however, they are in the same order with respect to the flow of acoustic power E. There are no moving parts required, as the acoustic power is simply transmitted using open ductwork. One limitation of this design is that the closed loop formed by the network 27, the STU 2, and the TBT 11 opens up a path for acoustic streaming, i.e. a second-order steady flow generated by the first-order acoustic oscillation. If unchecked, this steady flow may carry a heat leak. A fluid diode can be used to suppress this flow, but this technique may be unstable and thus unsuitable for many operating conditions. Alternately a membrane or bellows-like device can be placed in the ductwork to block the steady flow while allowing the first-order oscillating flow to pass. However, the introduction of moving mechanical components may reduce the reliability of the FPTR 21. An additional limitation arises for large FPTRs. When FPTRs are scaled up in cooling power, the cross-sectional areas of the STU 2, the TBT 11, and the secondary ambient heat exchanger 15 grow in proportion to the cooling power, whereas the lengths of the individual components remain relatively unchanged. The network 27 that recycles the acoustic power back to the main ambient heat exchanger 3 also grows in diameter while its length remains relatively unchanged. When the diameters become comparable to the lengths, connecting the ends of the network 27 to the STU 2 and the secondary ambient heat exchanger 15 becomes problematic, requiring extra length in the connections, causing extra dissipation of acoustic power due to sharp corners, and/or exacerbating flow-straightening problems at the ambient end of the TBT 11.

A related technique, shown in FIG. 3, utilizes a much longer, approximately half-wavelength-long feedback tube 31 to recycle the acoustic power from the ambient end of the FPTR's TBT 11 to the backside of the linear compressor's piston 33. If the FPTR 30 were driven by a thermoacoustic engine, the tube would rejoin the thermoacoustic engine/resonator system approximately half of a wavelength away from the refrigerator's main ambient heat exchanger. By placing the half-wavelength-long feedback tube 31 after the TBT 11, the acoustic volume flow rate into the half-wavelength-long feedback tube 31 is quite large resulting in large gas velocities. Combined with the length of the half-wavelength-long feedback tube 31, the high gas velocities result in significant acoustic dissipation, which may negate much of the benefit of recycling the acoustic power. Furthermore, if used on a thermoacoustic engine/resonator system, the half-wavelength-long feedback tube 31 opens up a streaming path similar to the path of FIG. 2.

Another related technique, disclosed in U.S. Pat. No. 4,114,380, utilizes two half-wavelength-long tubes to couple the STU of an acoustic-traveling-wave engine to the STU of an acoustic-traveling-wave refrigerator. The two STUs and half-wavelength-long tubes form a one-wavelength-long loop with the STUs separated from each other by a half wavelength in either direction. The loop allows the residual acoustic power from the cold end of the refrigerator STU to flow into the ambient end of the engine STU to be amplified and sent back to the ambient end of the refrigerator STU. One limitation of this technique is that the loop creates a path for streaming that decreases the performance of both the engine and refrigerator STUs. Another limitation of this technique is that the acoustic gain of the engine STU must be balanced by the acoustic attenuation of the refrigerator STU making control of the refrigerator STU's cold-end temperature dependent on the hot-end temperature of the engine STU.

Yet another technique, shown in FIG. 4, places an electrodynamic linear alternator 41 at some distance past the STU 2. The electrodynamic linear alternator 41 converts the previously dissipated acoustic power back into electricity that can be used to supply some of the electrical input to the acoustic wave generator 7. One limitation of this technique is that more moving components are introduced. In addition, the unit will also likely require electrical power conditioning equipment to make the phase of electrical power generated by the electrodynamic linear alternator 41 compatible with that required by the acoustic wave generator 7.

Yet another technique, disclosed in U.S. Pat. No. 6,658,862, is depicted in FIG. 5. In place of the acoustic network 9 of FIG. 1, a second-stage PTR 51 of smaller cross-sectional area is cascaded onto the ambient end of the TBT 11. The second-stage PTR 51 operates using the residual acoustic power from the first-stage STU 2. However, the phase relationship between the complex acoustic pressure amplitude $p_1$ and the complex volumetric flow rate amplitude $U_1$ at the input to the second-stage PTR 51 will not be optimal. If the first-stage STU 2 and the second-stage STU 64 operate at a cold-end temperature far from ambient, then the majority of the cooling power will be provided by the first-stage STU 2. Therefore, the acoustic pressure, volume flow rate, and the phase difference between them should be optimized for the operation of the first-stage STU 2. Typically this requires the acoustic volume flow rate phasor $U_1$ at the first-stage main ambient heat exchanger 3 to lead the acoustic pressure phasor $p_1$ in time phase by 0 to 50 degrees. After the acoustic wave has propagated through the first-stage STU 2 and TBT 11, the phase of $U_1$ will be lagging $p_1$ by 40-80 degrees which results in inefficient operation of the second-stage PTR 51. Any improvement in the acoustic input to the second stage will come at the expense of the efficiency of the first-stage STU 2 which is providing the majority of the cooling power and has a bigger effect on the overall system efficiency.

Yet another technique is shown in FIG. 6 and disclosed in U.S. Pat. No. 6,658,862. Instead of cascading a smaller PTR directly onto the end of a first-stage TBT 11, an intervening, approximately half-wavelength-long resonator 53 of roughly the same diameter as the first-stage STU 2 is used to modify the $p_1$ and $U_1$ phasors to values more favorable to second-stage PTR 51 performance. However, as discussed later in the detailed description of the present invention, the use of such a large diameter and length has several limitations, and causes the acoustic conditions at the inlet to the second-stage STU 64 to be very sensitive to the properties of the half-wavelength-long resonator 53 such as the temperature of the gas in the resonator. In addition, this technique leads to additional dissipation which can waste a significant fraction of the residual acoustic power exiting the first-stage STU 2.

For high power STUs, each of the aforementioned techniques has limitations in regard to the recovery or utilization of the residual acoustic power that flows away from STU 2: addition of moving mechanical components, creation of closed-loop streaming paths, the difficulty of designing smooth, compact ductwork paths from short, large-diameter piping, compromising the performance and efficiency of a first-stage refrigerator for the sake of adding a smaller, second stage, or excessive dissipation of first-stage residual acoustic power. A need exists, therefore, for a pulse-tube refrigerator which overcomes these limitations.

SUMMARY OF THE INVENTION

The present invention meets the aforementioned need and overcomes the limitations of previous techniques. As depicted in FIG. 7, a second-stage PTR 51 having a smaller cross-sectional-area than the first-stage STU 2 is serially coupled with the first-stage STU 2. However, instead of a traditional TBT 11 as shown in FIG. 1, the first-stage STU 2 is coupled to the second-stage STU 64 with an approximately quarter-wavelength-long coupling tube 55 and a relatively short second-stage compliance volume 62. The coupling tube 55 serves as the TBT for the first-stage STU 2 and, in combination with the second-stage compliance volume 62, modifies $p_1$ and $U_1$ so that the input conditions to the second-stage STU 64 are conducive to high second-stage efficiency. The configuration in FIG. 7 has several advantages, including a lack of moving parts; a lack of closed loop streaming paths; a coupling tube wherein the diameter is relatively small compared to its length, which facilitates shaping, if necessary; relatively low acoustic dissipation; acoustic inputs to the second-stage STU 64 that are nearly identical to the first-stage STU 2 (except for a lower volume flow rate due to the refrigeration effect of the first stage), allowing optimization of the entire system without having to compromise the performance of either stage; and reduced sensitivity of the second-stage-STU 64 inputs to the properties of the quarter-wavelength-long coupling tube 55 or the working fluid contained therein.

Those skilled in the art will recognize that quarter-wavelength-long coupling tube 55 and second stage compliance volume 62 can also be used to cascade two or more engine STUs, i.e. STUs where the heat exchanger following the regenerator is at a higher temperature than the heat exchanger preceding the regenerator. Another variant includes cascading a refrigerator STU with an engine STU. The following describes one non-limiting embodiment of the present invention. According to one embodiment of the present invention, a pulse-tube refrigerator assembly is provided, comprising a first stage Stirling thermal unit comprising a main ambient heat exchanger, a regenerator and a cold heat exchanger, wherein said first stage Stirling thermal unit is serially coupled to the first end of a quarter wavelength long coupling tube; and a second stage Stirling thermal unit comprising a main ambient heat exchanger, a regenerator, and a cold heat exchanger, wherein said second stage Stirling thermal unit is serially coupled to a second end of the quarter wavelength long coupling tube.

DETAILED DESCRIPTION OF THE INVENTION

As used herein, "before," "after," "proximal," "distal," or similar terms indicate a position relative to the direction of acoustic power flow which is indicated by arrows labeled by "E" in the Figures. For example, if component A is "after" component B, and the flow of acoustic power is indicated as left to right, then component A would be understood to be to the right of component B, the distal end of component A would be understood to be to the right of the proximal end of component A, and the distal end of component B would be understood to be to the right of the proximal end of component B.

As used herein, "cascade," or "cascading," means two or more components coupled in series.

As used herein, "coupled in series," "serially coupled," or other equivalent terms, means that the components are connected in series (i.e., the distal end of one component connected to the proximal end of another component), and in a manner which allows flow of heat, acoustic energy, working gas, etc. between the components and within the apparatus.

In all embodiments of the present invention, all ranges are inclusive and combinable. All numerical amounts are understood to be modified by the word "about" unless otherwise specifically indicated. All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

Figure 1:
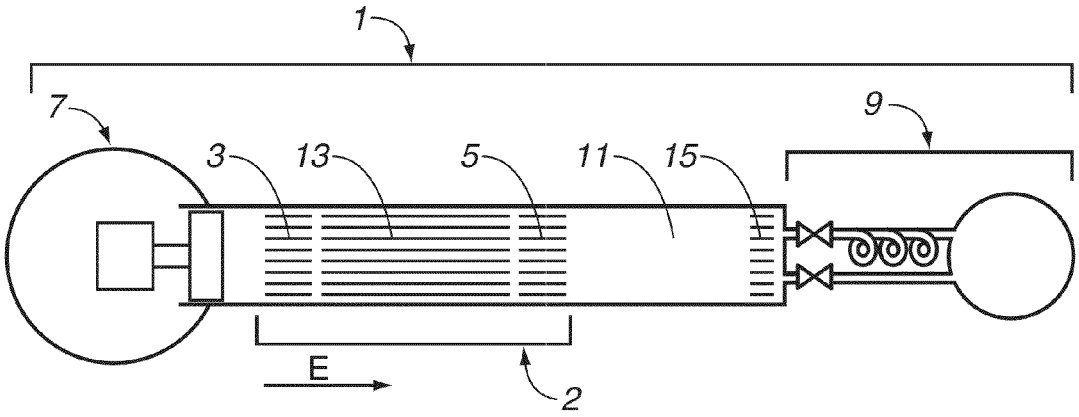
Fig. 1 Prior Art
FIG. 1 depicts a prior art conventional pulse tube refrigerator with acoustic input provided by an electrically driven linear compressor.
Figure 2:
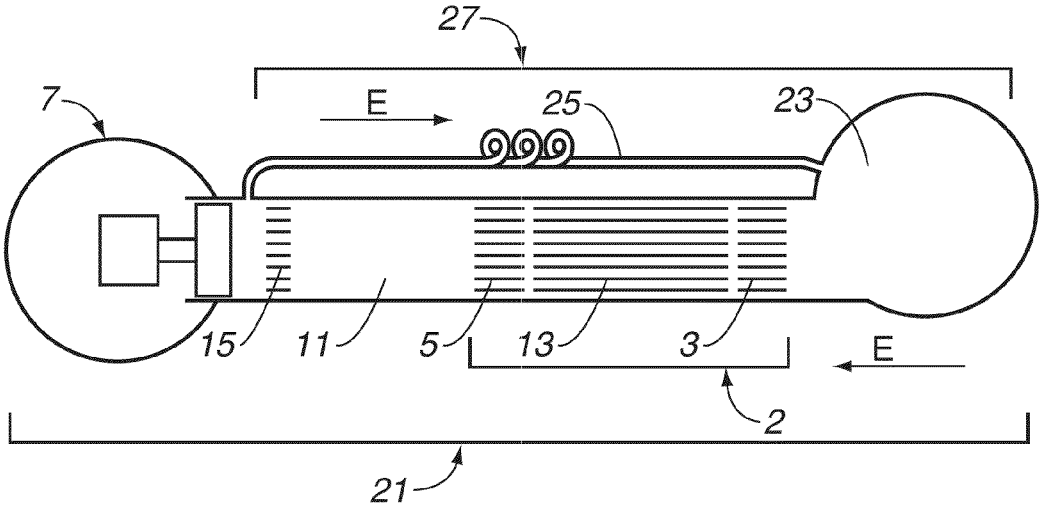
Fig. 2 Prior Art
FIG. 2 depicts a prior art feedback pulse tube refrigerator (FPTR) with lumped-element feedback ductwork to recover residual acoustic power.
Figure 3:
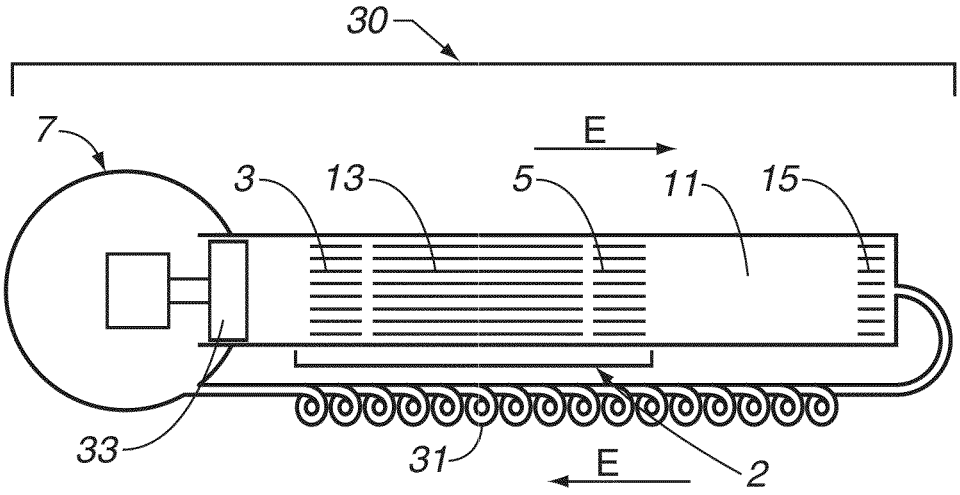
Fig. 3 Prior Art
FIG. 3 depicts a prior art feedback pulse tube refrigerator with an extended transmission line feedback tube to recover residual acoustic power.
Figure 4:
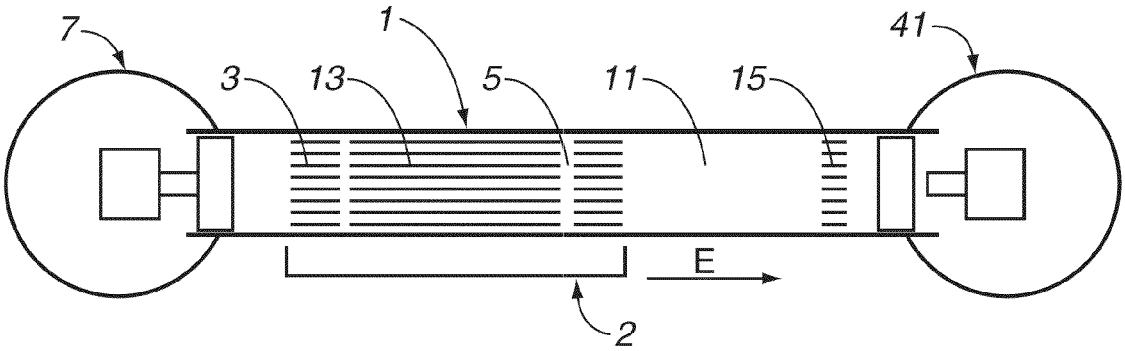
Fig. 4 Prior Art
FIG. 4 depicts a prior art pulse-tube refrigerator with electrical recovery of residual acoustic power.
Figure 7:
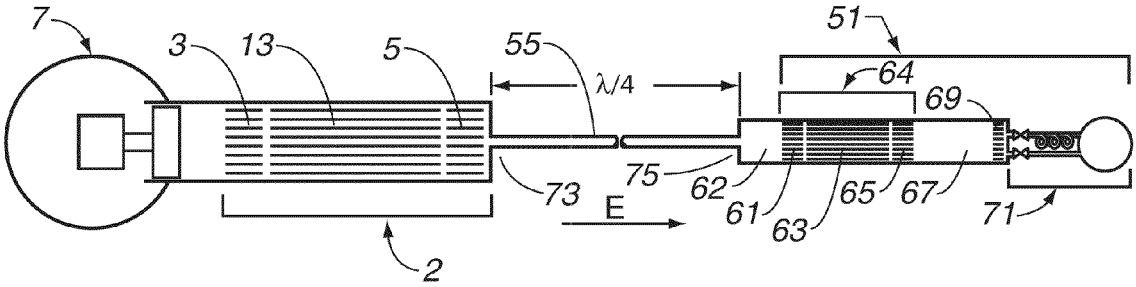
FIG. 7 depicts one embodiment of the present invention, which utilizes a quarter-wavelength-long coupling tube.

In one embodiment of the present invention, shown in FIG. 7, a first stage STU 2 and a second stage PTR 51, said second stage PTR comprising a second STU 64, are cascaded together, with the cold heat exchanger 5 of the first stage STU 2 connected to the main ambient heat exchanger 61 of the second stage STU 64 via a quarter-wavelength-long coupling tube 55 and compliance volume 62. The quarter-wavelength-long coupling tube 55 is connected to the first stage STU 2 via quarter-wavelength-long coupling tube inlet 73 and is connected to the compliance volume 62 via quarter-wavelength-long coupling tube outlet 75. The first stage STU 2 comprises a main ambient heat exchanger 3, a regenerator 13, and a cold heat exchanger 5. The second stage STU 64 comprises a second-stage main ambient heat exchanger 61, a second-stage regenerator 63, and a second-stage cold heat exchanger 65. One non-limiting example of a suitable first stage, including an acoustic wave generator 7, and including network 9 and TBT 11 of FIG. 1, which are not used in the first stage of the present invention, is described in R. Radebaugh, "A review of Pulse tube refrigeration," Advances in Cryogenic Engineering, vol. 35, pp. 1191-1205 (1990). The second stage PTR 51 further comprises a thermal buffer tube (TBT) 67, a secondary ambient heat exchanger 69, and an acoustic network 71 serially coupled to the second stage STU 64.

The following analytical expressions that describe the various embodiments of the present invention are qualitative in nature and do not take into account thermal and viscous loss and acoustically transported entropy. One of skill in the art would understand from the following expressions how to make and use the present invention. In addition, simulations using DeltaEC were used to provide a quantitatively accurate depiction of the detailed acoustic and thermodynamic processes of the present invention, including thermal and viscous loss and acoustically transported entropy. The DeltaEC User Guide describes its algorithms in detail and is available at www.lanl.gov/thermoacoustics, incorporated herein by reference.

To those skilled in the art, it is clear that if an acoustic wave with appropriate phasing between $p_1$ and $U_1$ is imposed at the main ambient heat exchanger 3 of the first stage STU 2, the first stage will produce a gross cooling power $Q_{c,gross,1}$ of approximately $$Q_{c,gross,1} \sim E_{a,1} \frac{T_c}{T_a}, \tag{1}$$

where $E_{a,1}$ is the acoustic power flowing into the first-stage main ambient heat exchanger 3, $T_a$ is the temperature of that heat exchanger, and $T_c$ is the temperature of the first-stage cold heat exchanger 5. The residual acoustic power $E_{a,2}$ that flows away from the first-stage cold heat exchanger 5 is also $$E_{a,2} \sim E_{a,1} \frac{T_c}{T_a}. \tag{2}$$

Figure 8:
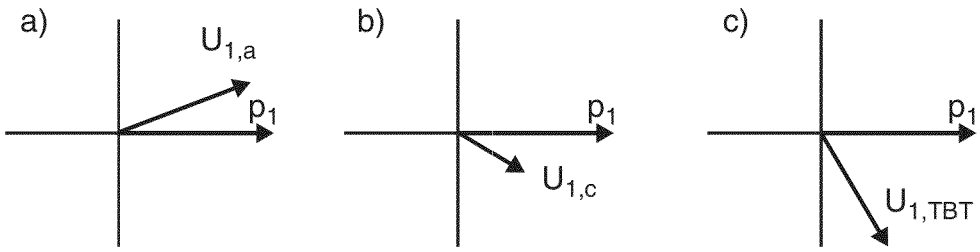
FIG. 8*a-c* depicts a schematic representation of the acoustic phasors in a PTR with a TBT.

To provide efficient operation of the first stage STU 2, the complex acoustic amplitudes (represented by phasors in FIG. 8) would be similar to those shown schematically in FIG. 8*a* where the phase of the pressure phasor has been arbitrarily set to zero. At the first-stage main ambient heat exchanger 3, the volume flow rate phasor $U_{1,a}$ leads the pressure phasor $p_1$ by approximately 0-50 degrees depending on the particular design of the first stage STU 2. As the acoustic wave propagates through the regenerator 13, the void volume of the regenerator and the reduction in mean temperature cause the volume flow rate phasor to evolve so that the volume flow rate phasor $U_{1,c}$ at the cold heat exchanger 5 is as schematically shown in FIG. 8*b*.

$U_{1,a}$ is chosen so that the average phase of $U_1$ relative to $p_1$ in the regenerator 13 is near zero which allows for the maximum acoustic power flow (i.e. maximum gross cooling power) with a minimum of viscous dissipation and acoustically transported entropy. In a traditional PTR, the residual acoustic power $E_{a,2}$ would simply be absorbed by the dissipative acoustic network 9 shown in FIG. 1. The coefficient of performance (COP) is the quantitative measure of efficiency of a refrigerator. The maximum COP of such a traditional PTR would be:

$$COP_{max} = \frac{Q_{c,gross,1}}{E_{a,1}} \sim \frac{T_c}{T_a} \tag{3}$$

as described in P. Kittel, *Cryogenics,* 32 (9), 843-844, (1992). If instead a second-stage PTR 51 was cascaded after the first stage PTR 1 and the first-stage residual acoustic power was transmitted to the second stage without dissipation, the second-stage PTR 51 would provide additional gross cooling power (as in FIG. 5, 6, or 7). The maximum gross cooling power of a second-stage PTR 51 $Q_{c,gross,2}$ would be $$Q_{c,gross,2} \sim E_{a,1}\left(\frac{T_c}{T_a}\right)^2 \tag{4}$$

if the second-stage ambient temperature $T_a$ and refrigeration temperature $T_c$ were the same as those in the first stage. The total gross cooling power and overall COP of the two-stage system would then be $$Q_{c,gross,1} + Q_{c,gross,2} \sim E_{a,1}\frac{T_c}{T_a}\left(1 + \frac{T_c}{T_a}\right) \tag{5}$$

$$COP_{max,two-stage} = \frac{Q_{c,gross,1} + Q_{c,gross,2}}{E_{a,1}} \sim \frac{T_c}{T_a}\left(1 + \frac{T_c}{T_a}\right). \tag{6}$$

The fractional increase in gross cooling power and COP over a traditional PTR is $(1+T_c/T_a)$ which is a 33.3% improvement for $T_c$=100 K and $T_a$=300 K. If instead of acoustic network 71, additional stages of STUs were added sequentially after the second stage, the maximum COP would be $$COP_{max,n-stage} = \frac{Q_{c,gross,1} + Q_{c,gross,2} + \ldots + Q_{c,gross,n}}{E_{a,1}} \sim \frac{T_c}{T_a}\left(1 + \frac{T_c}{T_a} + \ldots + \left(\frac{T_c}{T_a}\right)^{n-1}\right), \tag{7}$$

where n is the total number of STUs.

Figure 5:
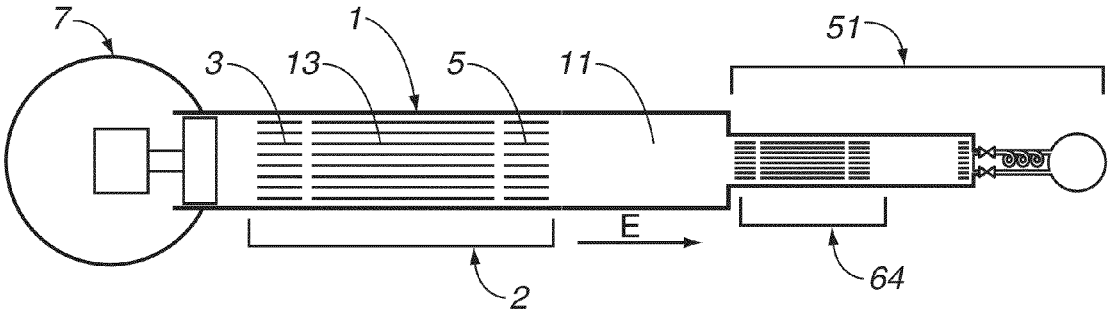
Fig. 5 Prior Art
FIG. 5 depicts a prior art staging technique to utilize the first-stage residual acoustic power.

The increase in COP and gross cooling power estimated above is very desirable, but it is not achievable with the configuration shown in FIG. 5. The open volume in the traditional TBT 11 would cause the volumetric flow rate phasor $U_{1,c}$ to evolve further and become $U_{1,TBT}$ at the ambient end of the TBT 11 (of FIG. 5) as schematically shown in Error! Reference source not found.c. Those skilled in the art will recognize that if the acoustic phasors in FIG. 8*c* were applied at the input of a second-stage STU, the COP of that STU would be greatly diminished with much of the potential gross cooling power lost to viscous dissipation and acoustically transported entropy. Therefore, the cascading method of FIG. 5 is not conducive to high second-stage performance and will certainly not allow more than two stages. The half-wavelength-long resonator 53 in FIG. 6 can remedy this situation by modifying both $p_1$ and $U_1$ along its length. However, the half-wavelength-long resonator 53 creates additional difficulties making its implementation problematic while the quarter-wavelength-long coupling tube 55 (in FIG. 7) of the present invention avoids these difficulties.

Ignoring for the moment acoustic dissipation and mean temperature variations, the acoustic phasors at the distal end of the half-wavelength-long resonator 53 or quarter-wavelength-long coupling tube 55, $p_{1,out}$ and $U_{1,out}$, are given by $$p_{1,out} = p_{1,c}\cos(\omega L/c) - i\frac{\rho c}{A_t}U_{1,c}\sin(\omega L/c)$$

$$U_{1,out} = U_{1,c}\cos(\omega L/c) - i\frac{A_t}{\rho c}p_{1,c}\sin(\omega L/c)$$

(Equations (8) and (9)), where ρ and c are the average density and speed of sound in the gas in the quarter-wavelength-long coupling tube 55 or the combination of the half-wavelength-long resonator 53 and first-stage TBT 11, L is the length of the quarter-wavelength-long coupling tube 55 or the combined length of the half-wavelength-long resonator 53 and first-stage TBT 11, $A_t$ is the cross-sectional area of the half-wavelength-long resonator 53 or the quarter-wavelength-long coupling tube 55, ω is the angular frequency of acoustic oscillations in the gas, and $p_{1,c}$ and $U_{1,c}$ are evaluated at the cold heat exchanger 5. Rewriting these equations yields $$p_{1,out}=p_{1,c}[\cos(\omega L/c)-(ie^{i\phi}/\Gamma_t)\sin(\omega L/c)]$$

$$U_{1,out}=U_{1,c}[\cos(\omega L/c)-(ie^{-i\phi}/\Gamma_t)\sin(\omega L/c)]$$

(Equations (10) and (11)) where ϕ is the phase of $U_{1,c}$ relative to $p_{1,c}$ and $\Gamma_t=|p_{1,c}/U_{1,c}|/(\rho c/A_t)$. These equations can now be used to explore what coupling tube area and length would be advantageous to cascade the second stage STU 64.

Figure 6:
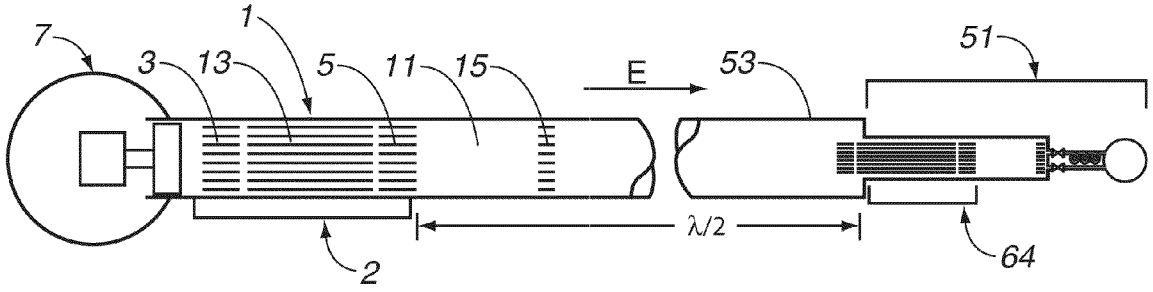
Fig. 6 Prior Art
FIG. 6 depicts yet another prior art staging technique to utilize the first-stage residual acoustic power.
Figure 9:
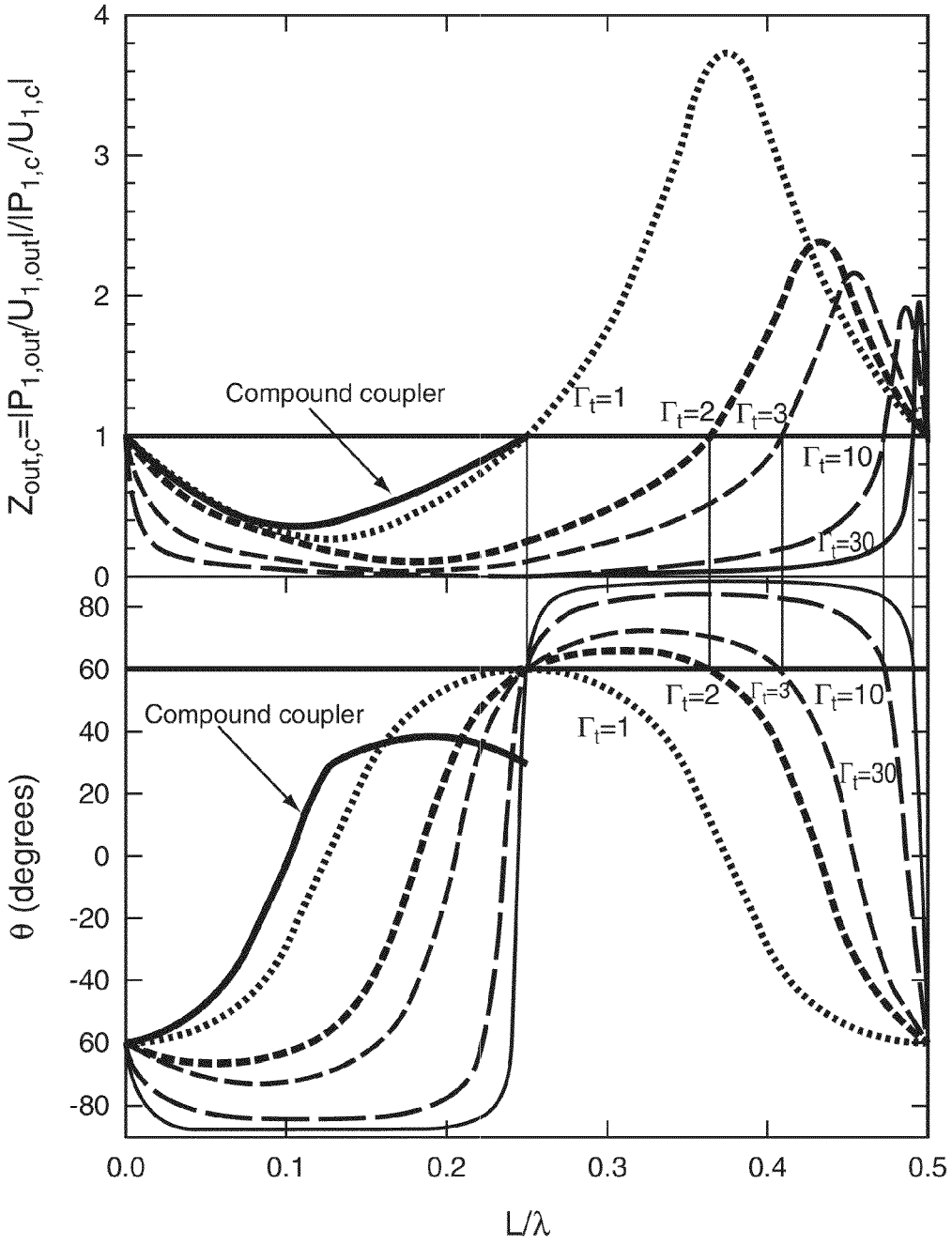
FIG. 9 depicts the magnitude and phase of the relative impedance as a function of the coupling tube length for different values of $\Gamma_t$ and for a compound coupler.

To achieve good performance and compactness of the second-stage STU 64 in FIG. 6 or FIG. 7, the magnitude of the complex acoustic impedance $|p_{1,out}/U_{1,out}|$ at the distal end of the half-wavelength-long resonator 53 or the quarter-wavelength-long coupling tube 55 should be equal or nearly equal to the magnitude of the impedance $|p_{1,c}/U_{1,c}|$ at the first stage cold heat exchanger 5 implying that the ratio $Z_{out,c}=|p_{1,out}/U_{1,out}|/|p_{1,c}/U_{1,c}|$ should be approximately 1. In addition, the phase θ of $U_{1,out}$ relative to $p_{1,out}$ should be in the range 0-50 degrees. FIG. 9 shows $Z_{out,c}$ and θ as a function of L/λ for ϕ=−60° and several different values of $\Gamma_t$. Here, λ is the average wavelength of the acoustic oscillation in the coupling tube, and $2\pi(L/\lambda)=\omega L/c$.

For values of $\Gamma_t$ of roughly 10 and higher, the values of L/λwhere $Z_{out,c}\sim 1$ are clustered near L/λ~0.5 corresponding to the half-wavelength-long resonator 53 of FIG. 6 and U.S. Pat. No. 6,658,862. The similarity to the coupling tube in U.S. Pat. No. 6,658,862 becomes clearer when it is realized that the normalized acoustic impedance at the first-stage cold heat exchanger 5 is typically $|p_{1,c}/U_{1,c}|/(\rho c/A_{STU})\sim 10-30$ which is similar to the half-wavelength-long resonator 53, i.e. $\Gamma_t=|p_{1,c}/U_{1,c}|/(\rho c/A_t)\geqq 10$, implying that $A_t\sim A_{STU}$ as shown in FIG. 6. Here, $A_{STU}$ is the cross-sectional area of the first stage STU 2.

When $L/\lambda=0.5$ and $Z_{out,c}=1$, FIG. 9 also shows that, $\theta=-\phi=60°$ which is advantageous for the acoustic input to the second STU 64. However, the steep slope of both $\theta$ and $Z_{out,c}$ vs. $L/\lambda$(for $\Gamma_t>>1$ and near $L/\lambda=0.5$) in FIG. 9 shows that small errors in $L/\lambda$can lead to significant changes in the acoustic input to the second STU 64. This extreme sensitivity can also be seen by evaluating the equations for $p_{1,out}$ and $U_{1,out}$ near $L/\lambda=0.5(\omega L/c=\pi)$:

$$p_{1,out}\approx p_{1,c}\left[1-ie^{i\phi}\frac{\Delta(\omega L/c)}{\Gamma_t}\right]$$

$$U_{1,out}\approx U_{1,c}[1-ie^{-i\phi}\Gamma_t\Delta(\omega L/c)]$$

(Equations (12) and (13)). Here $\Delta(\omega L/c)$ is the deviation of $\omega L/c$ from $\pi$. These equations show that for large values of $\Gamma_t$ the magnitude and phase of $U_{1,out}$ are very sensitive to small deviations in $\omega L/c$. A variation in any of one of $\omega$, L, or c from their design values will generate a $\Delta(\omega L/c)$. For example, fabrication tolerances or errors will affect L, variations in the temperature or composition of the gas in the coupling tube will affect c, and variations in the thermoacoustic engine frequency or compressor piston mass can affect $\omega$. As a concrete example, when $\Gamma_t=30$, a 3% deviation in $\omega L/c$ leads to a change in $U_{1,out}$ which is of the same order as $U_{1,c}$. A 3% deviation in c could be caused by a 6% deviation in mean temperature, e.g. the gas in the tube being at 318K as opposed to 300K. If the coupling tube 53 had the cross-sectional area of the second-stage STU 64 as opposed to the first stage STU 2, this situation would be only partially remedied as the cross-sectional area reduction (and therefore reduction in $\Gamma_t$) would only be a factor of two or three.

FIG. 9 shows that there is a new class of coupling tubes that overcomes the problems with previous approaches, such as the large $\Gamma_t$, half-wavelength-long geometry discussed above. As $\Gamma_t$ approaches 1, $Z_{out,c}=1$ when $L/\lambda=0.25$ where again $\theta=-\phi=60°$ (The fact that $Z_{out,c}=1$ and $\theta=-\phi$ simultaneously is not particular to $\phi=-60$. It occurs for all values of $\phi$ and $\Gamma_t$.) These solutions correspond to coupling tubes that are approximately one quarter of a wavelength long and have much smaller area than either STU (2 or 64) themselves (approximately 10-30 times smaller in area as $\Gamma_t=|p_{1,c}/U_{1,c}|/(\rho c/A_t)\sim 1$ for the coupling tube and $|p_{1,c}/U_{1,c}|/(\rho c/A_{STU})\sim 10-30$ for the STUs). Coupling tubes of this geometry correspond to quarter-wavelength-long coupling tube 55 shown in FIG. 7 and are the subject of the present disclosure. If $\theta=-\phi$ at the distal end of quarter-wavelength-long coupling tube 55 is not exactly optimal for the performance of the second stage STU 64, the second-stage compliance volume 62 can be used to decrease $\theta$.

The $\Gamma_t\sim 1$, quarter-wavelength-long coupling tube 55 has several advantages over the $\Gamma_t\sim 10-30$, half-wavelength-long coupling tube 53. First, quarter-wavelength-long coupling tube 55 is a quarter wavelength shorter than half-wavelength-long coupling tube 53, which for helium working gas at a frequency of 60 Hz near room temperature corresponds to roughly 4.75 meters; a significant reduction in length when trying to design compact refrigeration equipment. Second, Error! Reference source not found. shows that $p_{1,out}$ and $U_{1,out}$ for the quarter-wavelength-long coupling tube 55 are not as sensitive to variations in $L/\lambda$as the half-wavelength-long coupling tube 53. Analytically, this is seen by expanding the expressions for $p_{1,out}$ and $U_{1,out}$ near $\omega L/c\sim\pi/2$ (i.e. $L/\lambda\sim 0.25$) and $\Gamma_t\sim 1$:

$$p_{1,out}=p_{1,c}[-ie^{i\phi}-\Delta(\omega L/c)+ie^{i\phi}\Delta\Gamma_t]$$

$$U_{1,out}=U_{1,c}[-ie^{-i\phi}-\Delta(\omega L/c)-ie^{-i\phi}\Delta\Gamma_t]$$

(Equations (14) and (15)) where now $\Delta(\omega L/c)$ is the deviation of $\omega L/c$ from $\pi/2$ and $\Delta\Gamma_t$ is the deviation of $\Gamma_t$ from 1. Small deviations in either $\omega L/c$ or $\Gamma_t$ are no longer magnified by a large value of $\Gamma_t$ and the phasors at the distal end of quarter-wavelength-long coupling tube 55 are more robust.

A third advantage is that a $\Gamma_t\sim 1$ coupling tube will dissipate less acoustic energy than a coupling tube with $\Gamma_t\sim 10$ or larger. Acoustic dissipation can be split into two contributions; one from thermal relaxation and a second from viscous drag. Depending on the Reynolds number of the flow in the coupling tube, the viscous contribution can be either laminar or turbulent (see G. W. Swift, *Thermoacoustics: A Unifying Perspective for Some Engines and Refrigerators*. Acoustical Society of America, Sewickley, Pa. 2002 for a description of the dissipation mechanisms and formulae for their calculation). Initially considering the thermal relaxation contribution, the ratio of the acoustic energy lost in a $\Gamma=1$ quarter-wavelength-long tube to a $\Gamma_{large}>>1$, half-wavelength-long tube is $1/\sqrt{\Gamma_{large}}$ showing that the thermal dissipation is lower in a $\Gamma=1$ tube compared to a $\Gamma_{large}>>1$ tube. Taking the same ratio for the viscous contribution shows that the viscous dissipation in a $\Gamma=1$ tube is also smaller by $1/\sqrt{\Gamma_{large}}$ for the case of laminar flow. For turbulent flow, the calculation is simplified by assuming that the flow is always turbulent and the peak Reynolds number is large enough so that the friction factor can be approximated as a constant. In this limit, the viscous dissipation in a $\Gamma=1$ tube is smaller by the ratio $3\pi/8\sqrt{\Gamma_{large}}$. For each type of dissipation—thermal relaxation, laminar viscous, and turbulent viscous—a $\Gamma=1$ coupling tube dissipates less acoustic energy than a $\Gamma_{large}>>1$ coupling tube.

Those skilled in the art will recognize that the quarter-wavelength-long coupling tube 55 will fail to provide much of the benefit described above for acoustic power levels and physical sizes below a certain threshold. At low acoustic power levels, the cross-sectional area and diameter of the first-stage STU 2 are small, and the area of the quarter-wavelength-long coupling tube 55 is correspondingly smaller, resulting in high ratios of dissipative surface area to acoustic-power-transmitting cross-sectional area. A reasonable lower limit on the acoustic power level and physical size would be a size where less than ⅓ of the acoustic power flowing into the proximal end of the quarter-wavelength-long coupling tube 55 is incident on the second-stage ambient heat exchanger 61. For typical pulse-tube operating frequencies of 10-100 Hz, the lower limit is approximately given by $R/\delta_v\sim 35$ where R is the radius of the quarter-wavelength-long coupling tube 55 and $\delta_v$ is the average viscous penetration depth in the gas in the quarter-wavelength-long coupling tube 55. For an operating frequency of 60 Hz and a helium working gas at a mean pressure of 450 psia, this lower limit corresponds to a diameter of ~2 cm or an acoustic power leaving the first-stage cold heat exchanger of 1 kW.

Figure 10:
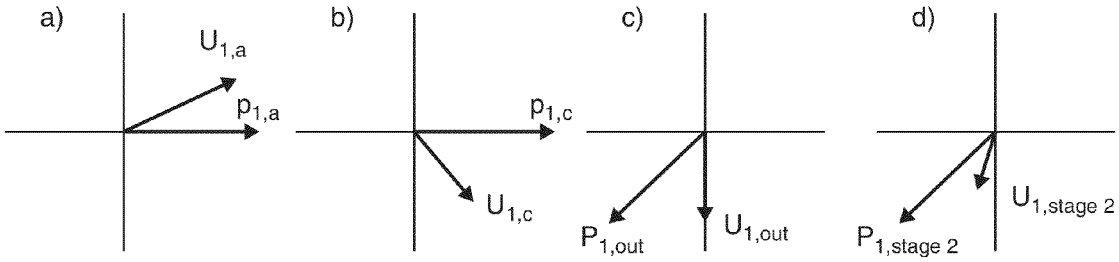
FIG. 10*a-d* depicts $p_1$ and $U_1$ phasors at several locations in the apparatus of FIG. 7.

Additional understanding of the operation of quarter-wavelength-long coupling tube 55 and second-stage compliance volume 62 can be gained by plotting the phasors $p_1$ and $U_1$ at various locations in FIG. 7. FIG. 10*a* shows the phasors at the main ambient heat exchanger 3 of the first STU 2. As the acoustic wave propagates through the first-stage regenerator 13 and cold heat exchanger 5, the phasors evolve into those shown in FIG. 10*b* where $U_{1,c}$ is now lagging $p_{1,c}$ (implying that $\phi<0$). As the wave propagates through the quarter-wavelength-long coupling tube 55, the previous equations for $p_{1,out}$ and $U_{1,out}$ show that $p_1$ is rotated by $-90°+\phi$ (which is a rotation whose magnitude is more than 90° when $\phi<0$) and $U_1$ is rotated by $-90°-\phi$. The result is that if $U_{1,c}$ lagged $p_{1,c}$ by $|\phi|$, then $U_{1,out}$ will lead $p_{1,out}$ by $|\phi|$ as shown in FIG. 10*c*. If this phase lead is more than optimal for the second-stage STU 64, then the compliance volume 62 allows for a shift in $U_{1,out}$ perpendicular to $p_{1,out}$ resulting in $p_{1,stage\ 2}$ and $U_{1,stage\ 2}$, the phasors at the second-stage main ambient heat exchanger 61 as shown in FIG. 10*d*.

To those skilled in the art, it is clear that adjustments of the coupling tube 55 geometry away from a quarter wavelength long and from an area giving $\Gamma_t=1$ will allow for fine tuning of the complex amplitudes $p_{1,out}$ and $U_{1,out}$ and can be used to compensate for the effects of dissipation in the quarter-wavelength-long coupling tube 55 on the phasors. In addition, the mean temperature variation along the quarter-wavelength-long coupling tube 55 will cause both $\rho$ and c to vary along the tube so that accurate determination of $p_{1,out}$ and $U_{1,out}$ for a given geometry will require a computer code such as DeltaEC. However, the general principles described above provide the framework for the design of the quarter-wavelength-long coupling tube 55 and compliance volume 62.

The combination of the quarter-wavelength-long coupling tube 55 and compliance volume 62 in FIG. 7 constitute a composite system for cascading, or coupling, the second stage STU 64 after the first stage STU 2. In the embodiment depicted in FIG. 7, the dimensions of the compliance volume 62 are much shorter than a quarter-wavelength making it behave as a lumped acoustic element. However, similar embodiments can be considered where the cross-sectional area of the compliance volume is decreased and its length increased to a point where it occupies a significant portion of the quarter wavelength. The curves labeled "compound coupler" in FIG. 9 show $Z_{out,c}$ and $\theta$ for a quarter-wavelength-long coupling tube whose first half has $\Gamma_t=0.765$ and whose second half has $\Gamma_t=1.572$ and the compliance volume 62 is absent. With $\phi=-60°$, this compound coupling tube achieves $Z_{out,c}=1$ and $\theta=30°$ in a total of a quarter wavelength without resorting to a compliance volume while retaining all the beneficial properties of a constant-cross-sectional-area, $\Gamma_t=1$ coupling tube such as small sensitivity to tube geometry and low dissipation. As explained below in reference to the thermal buffering aspects of the quarter-wavelength-long coupling tube 55, the change in area from the first half to the second half of the compound coupling tube should be made gently to avoid large secondary flows that could generate significant heat leaks.

In addition to providing the acoustic phasor modification discussed above, the coupling tube 55 or a compound variant must also provide thermal isolation between the first-stage cold heat exchanger 5 and the second-stage STU main ambient heat exchanger 61 so that the cooling power of the first-stage STU 2 is not degraded by heat leaks. There are several properties of the acoustic flow in the quarter-wavelength-long coupling tube 55 that might cause the gas in the tube to transport a significant amount of heat from the second-stage STU main ambient heat exchanger 61 to the first-stage cold heat exchanger 5, but there are several other properties that should diminish any heat leaks. Properties of the flow that may increase the heat leak include the following:

The phase of $U_1$ relative to $p_1$ in the quarter-wavelength-long coupling tube 55 generally evolves from a negative value between 0 and −50° near the first-stage cold heat exchanger 5 to a positive value between 0 and 50° near the second-stage main ambient heat exchanger 61. For the majority of the coupling tube length, the phasing between $P_1$ and $U_1$ may drive a significant amount of Rayleigh streaming (as described in U.S. Pat. No. 5,953,920) with a sheath of cold gas near the inner surface of the quarter-wavelength-long coupling tube 55 flowing from the first-stage cold heat exchanger 5 towards the second stage STU main ambient heat exchanger 61 and a core of ambient gas returning down the center of the tube. If no other processes affect this circulating flow, it may transport a significant amount of heat from the second stage STU main ambient heat exchanger 61 to the first-stage cold heat exchanger 5.

The reduction in area from the first STU 2 to the quarter-wavelength-long coupling tube 55 significantly increases the magnitude of the acoustic velocity amplitude $|u_1|=|U_1|/A_t$. The increase is large enough that the peak Reynolds number $Re_{\delta v}$ (based on viscous penetration depth $\delta_v$) of the oscillating flow in the quarter-wavelength-long coupling tube 55 can approach 500 to 1500 depending on the details of the first-stage STU 2 design. With $Re_{\delta v}$ this large, the acoustic boundary-layer in the coupling tube will be turbulent. The effect of a turbulent boundary layer on Rayleigh streaming is unknown; it may reduce or enhance the streaming flow. A turbulent boundary layer also violates all assumptions used to compute boundary-layer heat transport, as described in G. W. Swift, *Thermoacoustics: A Unifying Perspective for Some Engines and Refrigerators*, Acoustical Society of America, Sewickley, Pa. (2002). It is unclear whether entropy transported by boundary-layer processes will increase or decrease in the presence of a turbulent boundary layer. Although the effects on boundary-layer processes are unclear, the turbulence will certainly mix gas from different locations along the coupling tube's length, leading to an enhanced heat transport along the tube.

Due to turbulence and the unconventional acoustic phasing in the coupling tube 55, there are uncertainties in relation to the amount of heat transported along its length. However, there are several properties of the quarter-wavelength-long coupling tube 55 that will help minimize heat transport:

The small diameter and long length of the quarter-wavelength-long coupling tube 55 relative to a traditional TBT 11 puts the two counterflowing streams in a Rayleigh-streaming flow in close physical proximity, allowing for good heat exchange between the streams over the coupling tube's long length. The exchange of heat cools the flow near the tube center before it reaches the first-stage cold heat exchanger 5, effectively reducing the heat leak.

The diameter of the quarter-wavelength-long coupling tube 55 is much smaller than in TBT 11, providing a much smaller perimeter to support a boundary layer. With less perimeter, the amount of gas available to generate boundary-layer streaming and heat transport, whether due to laminar or turbulent flow, is reduced.

The long length of the quarter-wavelength-long coupling tube 55 relative to TBT 11 significantly reduces $dT_m/dx$, i.e., the gradient of the mean temperature along the quarter-wavelength-long coupling tube 55. The formula for boundary-layer heat transport valid for laminar flow has two terms, one of which is proportional to $dT_m/dx$. Although the details of this formula will differ for a turbulent boundary layer, the general form of the terms will likely be the same, so the lower $dT_m/dx$ will likely result in a significant reduction of this term.

TBT 11 typically has a ratio of its length to a peak-to-peak gas displacement of 3 to 6. In a typical quarter-wavelength-long coupling tube 55 design, this ratio is closer to 15 to 20. The long length relative to peak-to-peak gas displacement will greatly reduce the effect of mean temperature distortions at the ends of the quarter-wavelength-long coupling tube 55 which, in TBT 11, can lead to higher values of $dT_m/dx$ and larger boundary-layer heat transport.

The longer length and smaller diameter of the quarter-wavelength-long coupling tube 55 relative to TBT 11 allows for easier flow straightening of any flow maldistribution at either end of the coupling tube.

Those skilled in the art will recognize that the principles and advantages discussed in detail above apply equally well if the first-stage STU is an engine instead of a refrigerator. In this case, the quarter wavelength long coupling tube still transmits acoustic power efficiently from the first STU to the second STU and provides a desired acoustic impedance at the proximal end of the second-stage STU, although in this case the quarter wavelength long coupling tube transmits acoustic power from a hot temperature to ambient instead of from a cold temperature to ambient. Similarly, those skilled in the art will recognize that these principles and advantages apply equally well if the second-stage STU is an engine instead of a refrigerator.

Whereas particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A thermoacoustic refrigerator assembly comprising:
a first stage Stirling thermal unit (STU) comprising:
a main ambient heat exchanger,
a regenerator, and
at least one additional heat exchanger,
wherein said first stage STU is serially coupled to a first end of a quarter wavelength long coupling tube; and
a second stage pulse tube refrigerator.

2. The thermoacoustic refrigerator assembly of claim 1 wherein the second stage pulse tube refrigerator comprises a second stage STU.

3. The thermoacoustic refrigerator assembly of claim 2 wherein the second stage STU comprises:
a main ambient heat exchanger,
a regenerator, and
a cold heat exchanger,
wherein said second stage STU is serially coupled to a second end of the quarter wavelength long coupling tube.

4. The thermoacoustic refrigerator assembly of claim 1 further comprising a second stage compliance volume.

5. The thermoacoustic refrigerator assembly of claim 4 wherein the second stage compliance volume is inserted between the quarter wavelength long coupling tube and the second stage main ambient heat exchanger.

6. The thermoacoustic refrigerator assembly of claim 4 wherein the compliance volume is shorter than a quarter wavelength.

7. The thermoacoustic refrigerator assembly of claim 1 wherein the diameter of the coupling tube is less than its length.

8. The thermoacoustic refrigerator assembly of claim 1 wherein the second stage pulse tube refrigerator further comprises a thermal buffer tube.

9. The thermoacoustic refrigerator assembly of claim 1 wherein the second stage pulse tube refrigerator further comprises a secondary ambient heat exchanger.

10. The thermoacoustic refrigerator assembly of claim 2 wherein said second stage pulse tube refrigerator further comprises an acoustic network.

11. The thermoacoustic refrigerator assembly of claim 10 wherein the acoustic network is serially coupled to the second stage STU.

12. The thermoacoustic refrigerator assembly of claim 7 wherein the coupling tube defines a first cross-sectional area along a longitudinal axis and the first stage STU defines a second cross-sectional area along the longitudinal axis, and wherein the second cross-sectional area is greater than the first cross-sectional area.

13. The thermoacoustic refrigerator assembly of claim 7 wherein the coupling tube defines a first cross-sectional area along a longitudinal axis and the second stage STU defines a third cross-sectional area along the longitudinal axis, and wherein the third cross-sectional area is greater than the first cross-sectional area.

14. The thermoacoustic refrigerator assembly of claim 12 wherein the first cross-sectional area is between twelve and thirty times smaller than the second cross-sectional area.

15. The thermoacoustic refrigerator assembly of claim 13 wherein the first cross-sectional area is between twelve and thirty times smaller than the third cross-sectional area.

16. A thermoacoustic system having improved efficiency comprising:
a first-stage Stirling thermal unit (STU) having a hot or a cold heat exchanger;
a second-stage STU having an ambient heat exchanger;
a quarter-wavelength-long coupling tube;
wherein acoustic power is transmitted from said hot or cold heat exchanger in said first-stage STU to said ambient heat exchanger in said second-stage STU via said quarter-wavelength-long coupling tube.

17. The thermoacoustic system of claim 16, wherein said first-stage STU is an engine and said hot or cold heat exchanger is a hot heat exchanger.

18. The thermoacoustic system of claim 17, wherein said second-stage STU is an engine.

19. The thermoacoustic system of claim 17, wherein said second-stage STU is a refrigerator.

20. An apparatus comprising:
a first stage Stirling thermal unit (STU) coupled to a first end of a quarter wavelength long coupling tube; and
a second stage Stirling thermal unit (STU) coupled to a second end of the quarter wavelength long coupling tube
wherein the quarter wavelength long coupling tube defines a first cross-sectional area along a longitudinal axis and the first stage STU defines a second cross-sectional area along the longitudinal axis, and the second stage STU defines a third cross-sectional area along the longitudinal axis, and wherein the second and third cross-sectional areas are each greater than the first cross-sectional area.

* * * * *